United States Patent [19]

Cunningham

[11] 4,395,618

[45] Jul. 26, 1983

[54] ELECTRIC CIRCULATION HEATER FOR HEATING FLUIDS SUCH AS OIL

[75] Inventor: Donald M. Cunningham, Pittsburgh, Pa.

[73] Assignee: Emerson Electric Co., St. Louis, Mo.

[21] Appl. No.: 126,673

[22] Filed: Mar. 3, 1980

[51] Int. Cl.[3] ..... H05B 3/82; F24H 1/10; F28F 9/22

[52] U.S. Cl. ..... 219/298; 165/160; 219/299; 219/306; 219/320; 219/368; 219/374; 219/376; 219/382

[58] Field of Search ..... 219/296–299, 219/302–309, 321, 368, 374–376, 316, 320, 341, 381, 382; 165/160, 161

[56] References Cited

U.S. PATENT DOCUMENTS

| | | | |
|---|---|---|---|
| 336,802 | 2/1886 | Fairbanks | 165/160 |
| 602,521 | 4/1898 | Ray | 165/160 |
| 977,927 | 12/1910 | Bugnon | 219/299 X |
| 1,376,509 | 5/1921 | Borst | 219/320 X |
| 1,519,395 | 12/1924 | Clench | 219/306 X |
| 1,672,650 | 6/1928 | Lonsdale | 165/160 |
| 1,816,850 | 8/1931 | Hurd | 165/160 |
| 1,831,971 | 11/1931 | Sandstrom | 165/160 |
| 1,985,830 | 12/1934 | Hynes | 219/298 X |
| 2,511,635 | 6/1950 | Holmes | 219/306 X |
| 2,550,725 | 5/1951 | Schultz | 165/161 X |
| 2,577,832 | 12/1951 | Weiks | 165/160 |
| 2,775,682 | 12/1956 | Hynes | 219/306 |
| 2,987,604 | 6/1961 | Swoyer | 219/306 X |
| 3,108,174 | 10/1963 | Hynes | 219/307 X |
| 3,353,000 | 11/1967 | Tomlinson | 219/306 X |
| 3,673,385 | 6/1972 | Drugmand et al. | 219/306 X |
| 4,095,087 | 6/1978 | Giraud | 219/306 X |

FOREIGN PATENT DOCUMENTS

| | | | |
|---|---|---|---|
| 1111749 | 7/1961 | Fed. Rep. of Germany | 219/307 |
| 2111387 | 9/1972 | Fed. Rep. of Germany | 165/160 |
| 628186 | 6/1927 | France | 165/160 |
| 883949 | 12/1961 | United Kingdom | 165/160 |

OTHER PUBLICATIONS

"Chromalox Circulation Heaters"; Manual PE-109; 1976; Edwin L. Wiegand Division, Emerson Electric Co., Pittsburgh, Penna. 40 pp.

*Primary Examiner*—A. Bartis

*Attorney, Agent, or Firm*—Michael Williams

[57] ABSTRACT

A circulation heater for heating a fluid, particularly a liquid such as oil, includes an imperforate heavy-duty steel tubular body closed at both ends and having internal vanes establishing a plurality of separated longitudinally - extending chambers therein. The vanes are ported to establish a fluid flow path serially through the chambers from an inlet communicating with a first chamber to an outlet communicating with a last chamber. One or more metal-sheathed electric heating elements are located within each chamber and the chambers and heating elements therein are so arranged and designed, for example, by making the chambers of uniform transverse cross-sectional area and placing different numbers of heating elements of identical transverse cross-sectional area in each chamber, that the velocity of the fluid increases as it flows from the inlet to the outlet. The watt density of the heating elements in the respective chambers is correlated to the velocity of the fluid flowing through the chamber and temperature of the fluid in the chamber to prevent overheating of the fluid.

4 Claims, 4 Drawing Figures

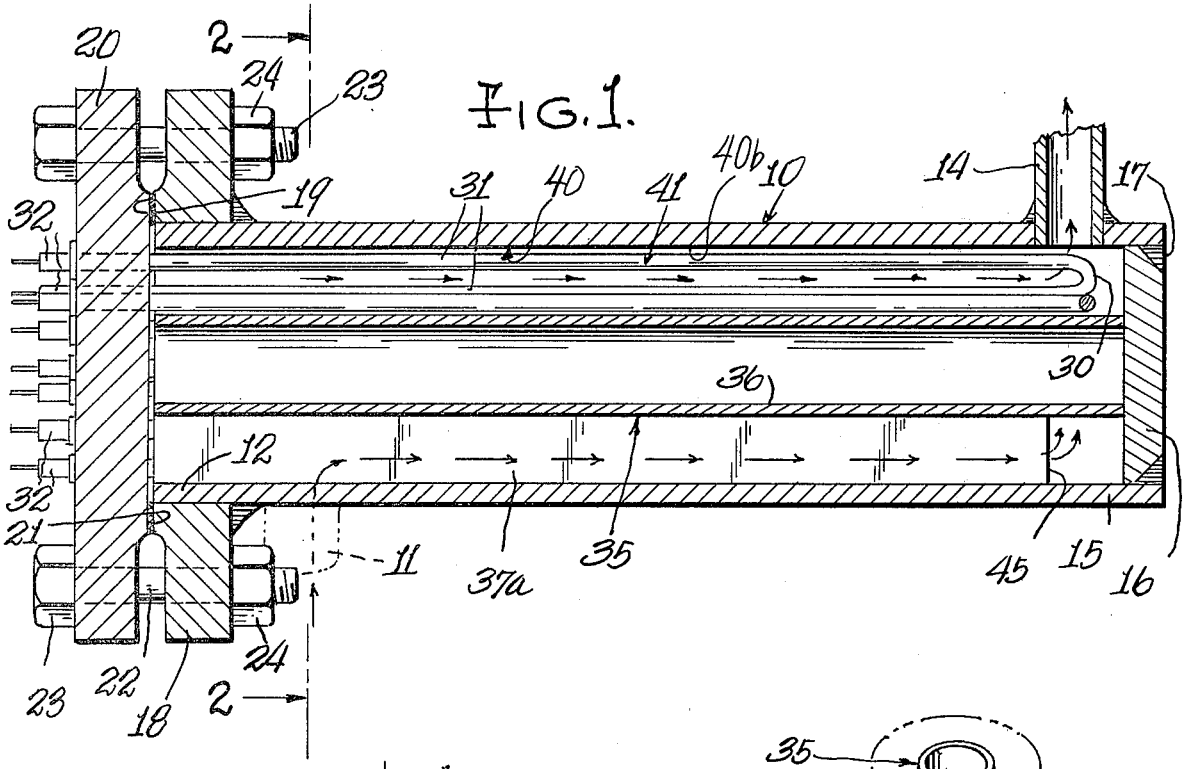
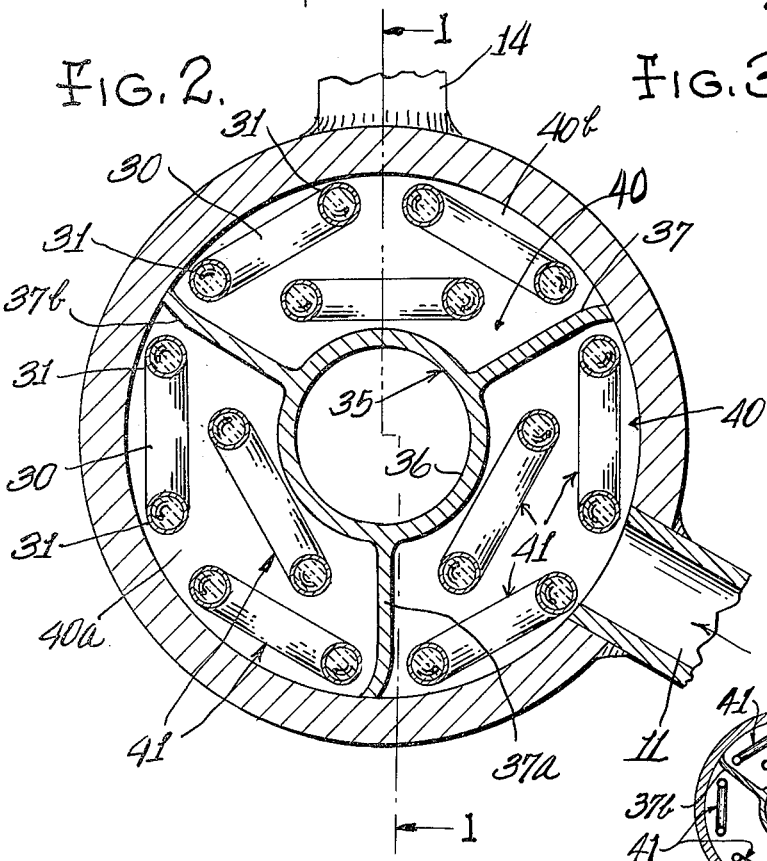
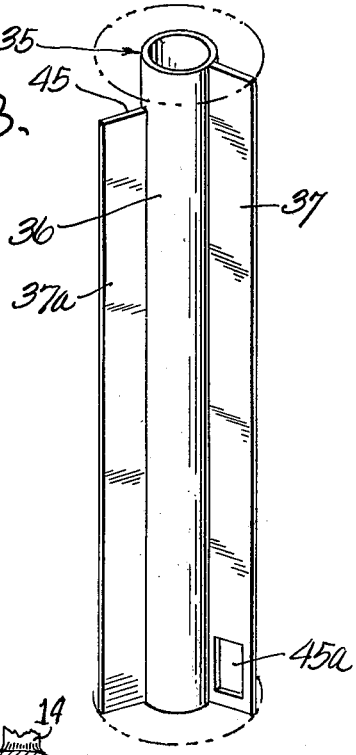
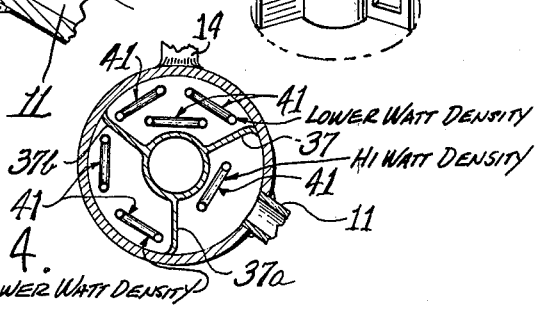
FIG. 4.

ELECTRIC CIRCULATION HEATER FOR HEATING FLUIDS SUCH AS OIL

BACKGROUND AND SUMMARY

Known in the prior art are heavy-duty tubular bodies in which sheathed electric heating elements are located to heat oil flowing from the inlet to the outlet of the body. In order to insure against leakage the inlet and outlet conduits of a body were sealed to the latter by circumferential welds, and like welds were used to seal the disc which closed one end of the body. In order to increase efficiency, several of such bodies were connected in series, but this unduly increased cost because of the extra material involved in such bodies, as well as the requirement of a multiplicity of welds.

My invention provides the advantages of serially-connected circulation heaters, without the increased cost of material and labor. This is accomplished by inserting a baffle member into a tubular body, the baffle member dividing the body into two or more longitudinally-extending chambers, the chambers being isolated from each other except for passages which connect the chambers in serial manner.

When heating oils, for example, it is a known fact that oils have a tendency to carbonize on the sheaths of electric heating elements when the temperature of the oil is approaching degrading temperature and where the flow rate of the oil is low and the watt density of the heating element is high, and such carbonization creates a thermal insulation layer on the sheath to reduce the thermal efficiency of the heating element and cause an early failure thereof.

Heretofore, carbonization was minimized by utilizing electric heating elements of low-watt densities, but this reduced the heating efficienty of the circulation heater. In use of my improved construction the electric heating element may be of relatively high-watt density and carbonization of oils is prevented by increasing the velocity of the oil flowing past the heating elements. Velocity is increased by reducing the cross section of the space through which the oil flows, and I accomplish this by means of a baffle disposed within the tubular body to divide the interior thereof into a plurality of longitudinally-extending chambers each containing one or more sheathed electric heating elements.

The baffle comprises a plurality of vanes radiating from a center section, the vanes having an inherent resiliency in a transverse direction and the longitudinal marginal of the vanes lie in a circle slightly larger than the inner wall surface of the cylindrical body. When the baffle is slid into the body through the open end of the latter, the longitudinal margins of the vanes engage the inner wall surface of the cylindrical body and are flexed transversely and thereby resiliently pressed against the inner wall surface to prevent fluid flow between the chambers past the longitudinal margins of the vanes.

The number of heating elements in each chamber formed by the baffle vanes may be varied to vary the transverse flow space and thus the velocity of the fluid flow. Further, the watt density of the heating elements in certain of the chambers may be varied to suit desired heating requirements.

DESCRIPTION OF THE DRAWING

In the drawing accompanying this specification and forming a part of this application there is shown, for purpose of illustration, an embodiment which my invention may assume, and in these drawings:

FIG. 1 is a longitudinal sectional view through a circulation heater, illustrating a preferred embodiment of my invention, the section corresponding to the line 1—1 of FIG. 2, FIG. 2 is an enlarged, transverse sectional view, corresponding to the line 2—2 of FIG. 1, FIG. 3 is a perspective view of a baffle member shown in the structures of FIGS. 1 and 2 and FIG. 4 is a sectional view similar to FIG. 2 but drawn to a reduced scale, the view showing a different number of heating elements in the respective longitudinally-extending chambers.

DESCRIPTION OF THE PREFERRED EMBODIMENT

Circulation heaters, particularly for heating oil, normally comprise a heavy-duty tubular body 10 which is usually cylindrical, as herein shown. The body has an inlet 11 at one end 12 and outlet 14 at the opposite end 15. The end 15 is closed by a metal disc 16 of substantial thickness, a circumferential weld 17 insuring against leakage at the body end 15. Circumferential welds are also made to seal the connections of the inlet and outlet to the body.

A metal flange 18 is connected by a circumferential weld about the end 12 of the body 10, this flange having a ground gasket surface 19. A circular head 20 is formed with a ground gasket surface 21, the surfaces 19 and 21 confronting each other, with a gasket 22 disposed therebetween. Heavy-duty bolts 23 have their shanks pass through aligned openings in the head 20 and the flange 18, and nuts 24 are tightened on the bolt shanks to squeeze the gasket 22 and prevent leakage of oil from the end 12 of the tubular body. The head 20 supports a plurality of sheathed electric heating elements, such as in groups as shown in FIG. 2. Each heating element is preferably of the hairpin type, having a bight 30 disposed at the end 15 of the tubular body and a pair of legs 31—31 extending longitudinally of the body and having terminal portions 32—32 extending transversely of the head 20 and through holes therein in leak-proof manner.

Before the head 20 is applied to the flange, and thus when the interior of the tubular body is unobstructed, a baffle member 35 is slid longitudinally into the body through the open 12 thereof. The baffle member may comprise an elongated thin-gauge section of extruded aluminum including a cylindrical post-like center section 36 and a plurality of integral longitudinally-extending vanes 37 having an inherent resiliency in a transverse direction. Instead of an extrusion, the center section 36 of the baffle member may be a thin-gauge steel pipe having vanes 37 welded thereto.

It is preferred that the free longitudinal ends of the vanes 37 lie in a circle slightly larger than the interior diameter of the tubular body, so that the vanes are slightly flexed transversely and resiliently pressed against the inner wall surface of the body as the baffle member is slid into the body. This causes a fairly close fit between the longitudinal ends of the vanes and the interior surface of the body to restrict flow of oil therepast.

The baffle member 35 herein disclosed is formed with three vanes 37, **37*a* and 37*b* but the number of vanes may vary from two to any practical number in accordance with requirements. The vanes in the present embodiment form three longitudinally-extending chambers 40 and one or more hairpin heaters 41 extend longitudinally within each chamber. The heaters, in combination with the cylindrical center section 36**, reduce the transverse space of each chamber a predetermined amount and therefore correspondingly increase the velocity of the oil flowing through such chamber.

My invention provides a very compact, yet highly efficient heater construction, in that the oil flowing from the inlet 11 to the outlet 14 must pass through the three chambers as if the latter were arranged in serial end-to-end relation. As seen in FIG. 3 a vane 37 has an opening 45 therethrough at one end of the baffle member 35, and an adjoining vane 37 has an opening 45*a* therethrough at the opposite end of the baffle member. The vane openings may be formed as an interruption of a vane at its end portion, as shown by the upper opening 45 in FIG. 3, or by a window through the vane, as shown by the lower opening 45*a* in FIG. 3.

Thus, oil entering the inlet 11 of the body 10 will travel downwardly in chamber 40 (downwardly at right angle to the plane of the paper as viewed in FIG. 2 or to the right as viewed in FIG. 1) to the end 15 of the tubular body 10, and then pass through an opening 45 in the vane 37*a* to the chamber 40*a*. The oil will travel in the opposite direction in the chamber 40*a* (upwardly at right angle to the plane of the paper as viewed in FIG. 2 and to the left as viewed in FIG. 1) and pass through an opening in that portion of the vane 37*b* that is located near the end 12 of the body, to flow to the chamber 40*b*. The oil will travel in the opposite direction in the chamber 40*b* (downwardly at right angle to the plane of the paper as viewed in FIG. 2 and to the right as viewed in FIG. 1) to the outlet 14. In order to prevent "short cutting" of oil between chambers at the ends thereof, gasket material (not shown) may be applied to opposite ends of the baffle member for respective cooperation with the interior surface of the closure disc 16 and the ground surface 21 of the head 20.

In the embodiment specifically illustrated herein, the tubular body 10 has an interior diameter of about five inches (about 127 millimeters). The outside diameter of the tubular sheath of each electric heating element is about 0.475 inches (about 12 millimeters).

According to calculations the cross section of the space within the five-inch pipe is equal to 0.13898 square foot, and the transverse space occupied by nine hairpin heating elements is equal to 0.02215 square feet. The baffle 35 has been so constructed that its center section 36 and vanes 37 occupy a transverse space equal to 0.0236 square feet. Therefore, the total free transverse space within the body 10 is 0.031 square feet and with three equal chambers the free transverse space in each chamber is 0.131 square feet. At a flow rate of oil at 12 gallons per minute (0.0267 cubic foot per second), the velocity of oil flow in each chamber is 0.86–1.0 foot per second and this will permit use of electric heating elements of 15 to 20 watts per square inch, a very satisfactory amount of heat for efficient heat transfer.

The baffle member 35 is slid into the tubular body to form the chambers 40,40*a* and 40*b* which may be equal as shown in FIG. 2, or of different transverse size and/or longitudinal length. After the baffle member is slid into the body, the head 20 is oriented to dispose the heating elements within respective chambers and position the head in juxtaposed relation with the flange 18 for connection to the latter by the bolts and nuts 23 and 24.

The number of heating elements, and the watt density thereof, may be varied to suit desired heating requirements. For example as air or other gas enters the inlet 11 at, for example, ambient temperature, it may be desirable to apply high heat and relatively low velocity in the first chamber and gradually reduce heat or increase velocity as the gas approaches the chamber connected with the outlet.

This is particularly desirable when heating a liquid such as oil, where the watt density of the heating elements is related to the viscosity and temperature of the oil. For example, with oil at, say, ambient temperature being pumped through the inlet 11 to the first chamber 40, it would be desirable to have only one heating element (FIG. 4) of high-watt density in this chamber, so as to apply considerable heat to the oil while the velocity of the latter is relatively low. As the oil flows to surrounding chambers and increases in temperature, the number of heating elements may be increased so as to occupy more transverse space and thus increase velocity of the oil, and the watt density of the heating elements may be chosen comparable with velocity of prevent carbonization of the oil.

I claim:

1. A circulation heater for heating a fluid, comprising:

an imperforate tubular body having one end closed and the other end open, a head connected to said body to close and seal said open end, a baffle member longitudinally within said body and extending from the inner surface of said closed end to the inner surface of said head, said baffle member having a plurality of radially-extending vanes engaging the interior surface of said body and establishing therewith a plurality of separated longitudinaly extending chambers of equal transverse cross sectional area, a plurality of elongated metal-sheathed electric heating elements carried by said head, said heating elements being of equal transverse cross section and having their terminal portions extending in sealed relation through openings in said head, said heating elements being disposed longitudinally within said chambers, said body having an inlet for fluid to be heated and an outlet for the exhaust of the heated fluid, said inlet communicating with one body chamber and said outlet communicating with another body chamber, said vanes being ported to establish fluid flow from said inlet, serially through said chambers and outwardly of said outlet, a certain number of said heating elements being disposed longitudinally within a certain of said body chambers and a different number of said heating elements being disposed in a certain other of said body chambers, whereby the effective transverse cross sectional area of the flow-through space in said certain and said certain other of said body chambers is different to accordingly cause variation of the velocity of the fluid flowing through such chambers.

2. The construction according to claim 1 wherein the watt density of said heating elements in said chambers is inversely proportional to the velocity of the fluid flowing through the respective chambers.

3. A circulation heater for heating a fluid, comprising:

an imperforate tubular body closed at both ends, vane means within said body to establish at least two separated, longitudinally-extending chambers therein, said body having an inlet for fluid to be heated and an outlet for the exhaust of the heated fluid, said inlet communicating with one body chamber and said outlet communicating with another body chamber, said vane means being ported to establish fluid flow from said inlet, serially through said chambers and outwardly of said outlet, said serially-arranged chambers being so designed that the velocity of the fluid from said inlet to and through said one chamber is low and said fluid increasing in velocity as it flows through the others of said at least two chambers and outwardly of said outlet, and electric heating elements in said chambers, the watt density of said heating elements being inversely proportional to the velocity of the fluid flowing through the respective chambers.

4. The construction according to claim 3 wherein all of said chambers are of equal transverse cross sectional area, and wherein a heating element is disposed within said one chamber and constructed and arranged to reduce the effective transverse cross sectional size of the flow-through area a certain amount, said heating element having a relatively high watt density, and a heating element disposed within another of said at least two chambers and constructed and arranged to reduce the effective transverse cross sectional size of the flow-through area thereof an amount greater than said certain amount in order to increase velocity of the fluid flowing through said another chamber, the heating element in said another chamber having a lower watt density than that in said one chamber.

* * * * *